US007116276B2

(12) United States Patent
Lee

(10) Patent No.: US 7,116,276 B2
(45) Date of Patent: Oct. 3, 2006

(54) ULTRA WIDEBAND INTERNAL ANTENNA

(75) Inventor: Jae Chan Lee, Yongin (KR)

(73) Assignee: Samsung Electro-Mechanics Co., Ltd., Kyungki-do (KR)

( * ) Notice: Subject to any disclaimer, the term of this patent is extended or adjusted under 35 U.S.C. 154(b) by 0 days.

(21) Appl. No.: 11/092,187

(22) Filed: Mar. 29, 2005

(65) Prior Publication Data

US 2006/0103577 A1 May 18, 2006

(30) Foreign Application Priority Data

Nov. 15, 2004 (KR) ..... 10-2004-0093011

(51) Int. Cl.
*H01Q 1/38* (2006.01)

(52) U.S. Cl. ..... 343/700 MS; 343/769

(58) Field of Classification Search ..... 343/700 MS, 343/769, 767, 770, 771, 846
See application file for complete search history.

(56) References Cited

U.S. PATENT DOCUMENTS 5,828,340 A 10/1998 Johnson ..... 343/700 MS
6,278,410 B1 * 8/2001 Soliman et al. ..... 343/769
6,300,908 B1 * 10/2001 Jecko et al. ..... 343/700 MS
6,914,573 B1 * 7/2005 McCorkle ..... 343/700 MS

* cited by examiner

*Primary Examiner*—Tuyet Vo
*Assistant Examiner*—Ephrem Alemu
(74) *Attorney, Agent, or Firm*—Volpe And Koenig, P.C.

(57) ABSTRACT

The present invention relates to an ultra wideband internal antenna, which is provided in a mobile communication terminal to cut off frequencies in a certain frequency band while processing ultra wideband signals.

The ultra wideband internal antenna includes a first radiation part, a second radiation part, a feeding part and a ground part. The first radiation part is made of a metal plate on a top surface of a dielectric substrate and is provided with at least one cut part, formed by cutting out a lower corner portion thereof, and an internal slot. The second radiation part is formed in the slot of the first radiation part while being connected to the first radiation part, the second radiation part being conductive. In this case, the first and second radiation parts form an ultra wide band due to electromagnetic coupling therebetween using individual currents flowing into the first and second radiation parts.

10 Claims, 6 Drawing Sheets

ULTRA WIDEBAND INTERNAL ANTENNA

RELATED APPLICATIONS

The present application is based on, and claims priority from, Korean Application Number 2004-0093011, filed Nov. 15, 2004, the disclosure of which is incorporated by reference herein in its entirety.

BACKGROUND OF THE INVENTION

1. Field of the Invention

The present invention relates generally to an antenna provided in a mobile communication terminal to transmit and receive radio signals and, more particularly, to an ultra wideband internal antenna, which is provided within a mobile communication terminal and is capable of cutting off frequencies in a specific frequency band while processing ultra wideband signals.

2. Description of the Related Art

Currently, mobile communication terminals are required to provide various services as well as be miniaturized and lightweight. To meet such requirements, internal circuits and components used in the mobile communication terminals trend not only toward multi-functionality but also toward miniaturization. Such a trend is also applied to an antenna, which is one of the main components of a mobile communication terminal.

For antennas generally used for mobile communication terminals, there are helical antennas and Planar Inverted F Antennas (hereinafter referred to as "PIFA"). Such a helical antenna is an external antenna fixed on the top of a terminal and has a function of a monopole antenna. The helical antenna having the function of a monopole antenna is implemented in such a way that, if an antenna is extended from the main body of a terminal, the antenna is used as a monopole antenna, while if the antenna is retracted, the antenna is used as a $\lambda/4$ helical antenna.

Such an antenna is advantageous in that it can obtain a high gain, but disadvantageous in that Specific Absorption Rate (SAR) characteristics, which are the measures of an electromagnetic wave's harm to the human body, are worsened due to the omni-directionality thereof. Further, since the helical antenna is designed to protrude outward from a terminal, it is difficult to design the external shape of the helical antenna to provide an attractive and portable terminal. Since the monopole antenna requires a separate space sufficient for the length thereof in a terminal, there is a disadvantage in that product design toward the miniaturization of terminals is hindered.

In the meantime, in order to overcome the disadvantage, a Planar Inverted. F Antenna (PIFA) having a low profile structure has been proposed. FIG. 1 is a view showing the construction of a general PIFA.

The PIFA is an antenna that can be mounted in a mobile terminal. As shown in FIG. 1, the PIFA basically includes a planar radiation part 1, a short pin 3 connected to the planar radiation part 1, a coaxial line 5 and a ground plate 7. The radiation part 1 is fed with power through the coaxial line 5, and forms impedance matching by short-circuiting the ground plate 7 using the short pin 3. The PIFA must be designed in consideration of the length L of the radiation part 1 and the height H of the antenna according to the width $W_P$ of the short pin 3 and the width W of the radiation part 1.

Such a PIFA has directivity that not only improves Specific Absorption Rate (SAR) characteristics by attenuating a beam (directed to a human body) in such a way that one of all the beams (generated by current induced to the radiation part 1), which is directed to the ground, is induced again, but also enhances a beam induced in the direction of the radiation part 1. Furthermore, the PIFA acts as a rectangular microstrip antenna, with the length of the rectangular, planar radiation part 1 being reduced by half, thus implementing a low-profile structure. Furthermore, the PIFA is an internal antenna that is mounted in a terminal, so that the appearance of the terminal can be designed beautifully and the terminal has a characteristic of being invulnerable to external impact.

Generally, Ultra WideBand (UWB) denotes an advanced technology of realizing together the transmission of high capacity data and low power consumption using a considerably wide frequency range of 3.1 to 10.6 GHz. In Institute of Electrical and Electronic Engineers (IEEE) 802.15.3a, the standardization of UWB has progressed. In such a wideband technology, the development of low power consumption and low cost semiconductor devices, the standardization of Media Access Control (MAC) specifications, the development of actual application layers, and the establishment of evaluation methods in high frequency wideband wireless communication have become major issues. Of these issues, in order to execute a wideband technology in mobile communication applications, the development of a small-sized antenna that can be mounted in a portable mobile communication terminal is an important subject. Such an ultra wideband antenna is adapted to convert an electrical pulse signal into a radio wave pulse signal and vice versa. In particular, when an ultra wideband antenna is mounted in a mobile communication terminal, it is especially important to transmit and receive a radio wave without the distortion of a pulse signal in all directions. If the radiation characteristic of an antenna varies according to direction, a problem occurs such that speech quality varies according to the direction the terminal faces. Further, since a pulse signal uses an ultra wide frequency band, it is necessary to maintain the above-described isotropic radiation pattern uniform with respect to all frequency bands used for communication.

FIG. 2 is a view showing the construction of a conventional wideband antenna.

The antenna shown in FIG. 2 is a wideband antenna disclosed in U.S. Pat. No. 5,828,340 entitled "Wideband sub-wavelength antenna". A wideband antenna 2 of the U.S. Patent includes a tap 10 having a tapered region 20, a ground plane 14 and a feeding transmission line 12 on a substrate 4. The bottom end 18 of the tap 10 has a width equal to that of a center conductor 12*a* of the feeding transmission line 12. The tapered region 20 is located between the top edge 16 and the bottom end 18 of the tap 10. Such a conventional wideband antenna has a frequency bandwidth of about 40%. However, when a radiation pattern in a horizontal plane, that is, a radiation pattern formed in y-z directions, is observed using a frequency function, the conventional wideband antenna exhibits isotropy in a low frequency band, but much radiation occurs in the transverse direction of the tap 10 (that is, a y direction) as the frequency increases. That is, the wideband antenna 2 is advantageous in that in an inexpensive planar wideband antenna can be implemented using Printed Circuit Board (PCB) technology, but problematic in that, as the frequency increases, serious distortion occurs and the antenna 2 has directionality. Further, the antenna is also problematic in that, since the size of the tap 10 emitting radiation is somewhat large, the tap 10 must occupy a large space in a mobile terminal.

Further, the conventional ultra wideband antenna 2 is problematic in that, since it uses frequencies in a 3.1 to 10.6

GHz wide frequency band, the operational frequencies of the frequency band of the ultra wideband antenna 2 overlap with those of other existing communication systems, thus interfering with communication therebetween. For example, since a wireless LAN uses frequencies in a 5.15 to 5.35 GHz wideband (US standard), the frequencies of the wireless LAN may overlap with those of the wideband antenna using the frequencies in the 3.1 to 10.6 GHz frequency band, thus interfering with the communication between respective communication systems.

SUMMARY OF THE INVENTION

Accordingly, the present invention has been made keeping in mind the above problems occurring in the prior art, and an object of the present invention is to provide an ultra wideband internal antenna, which can be easily miniaturized while being provided within a mobile communication terminal.

Another object of the present invention is to provide an ultra wideband internal antenna, which has a frequency cutoff function to solve a frequency overlapping problem occurring in combination with other existing communication systems while being provided within a mobile communication terminal and being capable of processing ultra wideband signals.

In order to accomplish the above objects, the present invention provides an ultra wideband internal antenna, comprising a first radiation part made of a metal plate on a top surface of a dielectric substrate and provided with at least one cut part, formed by cutting out a lower corner portion thereof, and an internal slot; a second radiation part formed in the slot of the first radiation part while being connected to the first radiation part, the second radiation part being conductive; a feeding part for supplying current to the first and second radiation parts; and a ground part for grounding both the first and second radiation parts, wherein the first and second radiation parts form an ultra wide band due to electromagnetic coupling therebetween using individual currents flowing into the first and second radiation parts.

Preferably, the first radiation part may have an outer circumference formed in a substantially rectangular shape.

Preferably, the cut part may be a polygonal cut part having a polygonal surface or may be an arcuate cut part that is formed by cutting the lower corner portion of the first radiation part in a gentle curve shape and is provided with a circular surface.

Preferably, the ultra wideband internal antenna may further comprise at least one stub made of a conductive stripline and connected to the cut part of the first radiation part to cut off frequencies in a predetermined frequency band.

Preferably, the stub may be formed to be inclined at a predetermined angle with respect to the feeding part, and symmetrically formed around the feeding part.

Preferably, the internal slot of the first radiation part and the second radiation part may be formed in a substantially circular shape.

Preferably, the feeding part may be formed in a CO-Planar Waveguide Ground (CPWG) structure.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
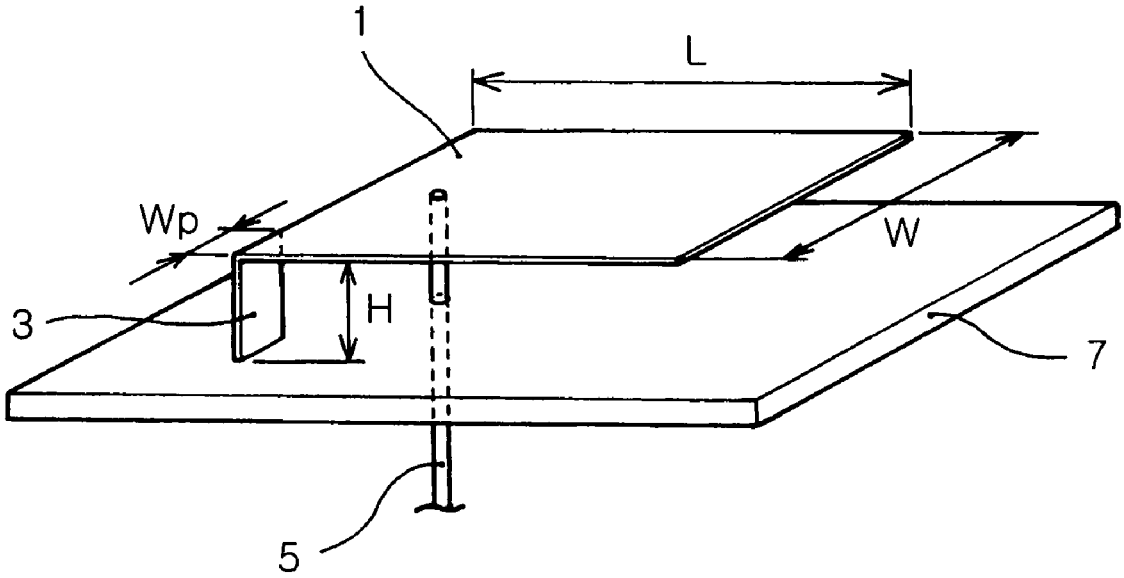
PRIOR ART FIG. 1
FIG. 1 is a view showing the construction of a typical Planar Inverted F Antenna (PIFA)
Figure 2:
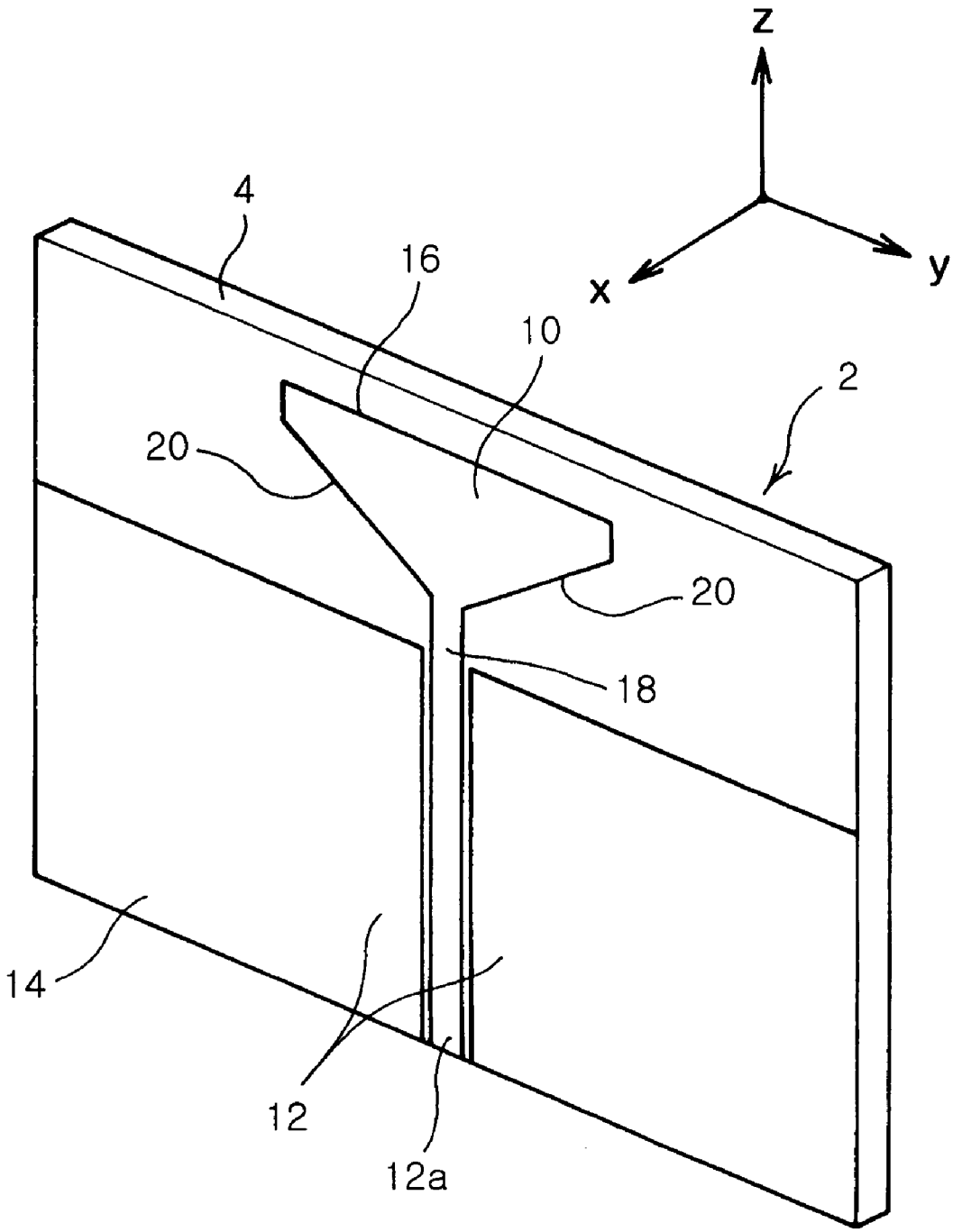
PRIOR ART FIG. 2
FIG. 2 is a view showing the construction of a conventional ultra wideband antenna.

Preferred embodiments of the present invention are described with reference to the attached drawings below. Reference now should be made to the drawings, in which the same reference numerals are used throughout the different drawings to designate the same or similar components. In the following description of the present invention, detailed descriptions may be omitted if it is determined that the detailed descriptions of related well-known functions and construction may make the gist of the present invention unclear.

Figure 3:
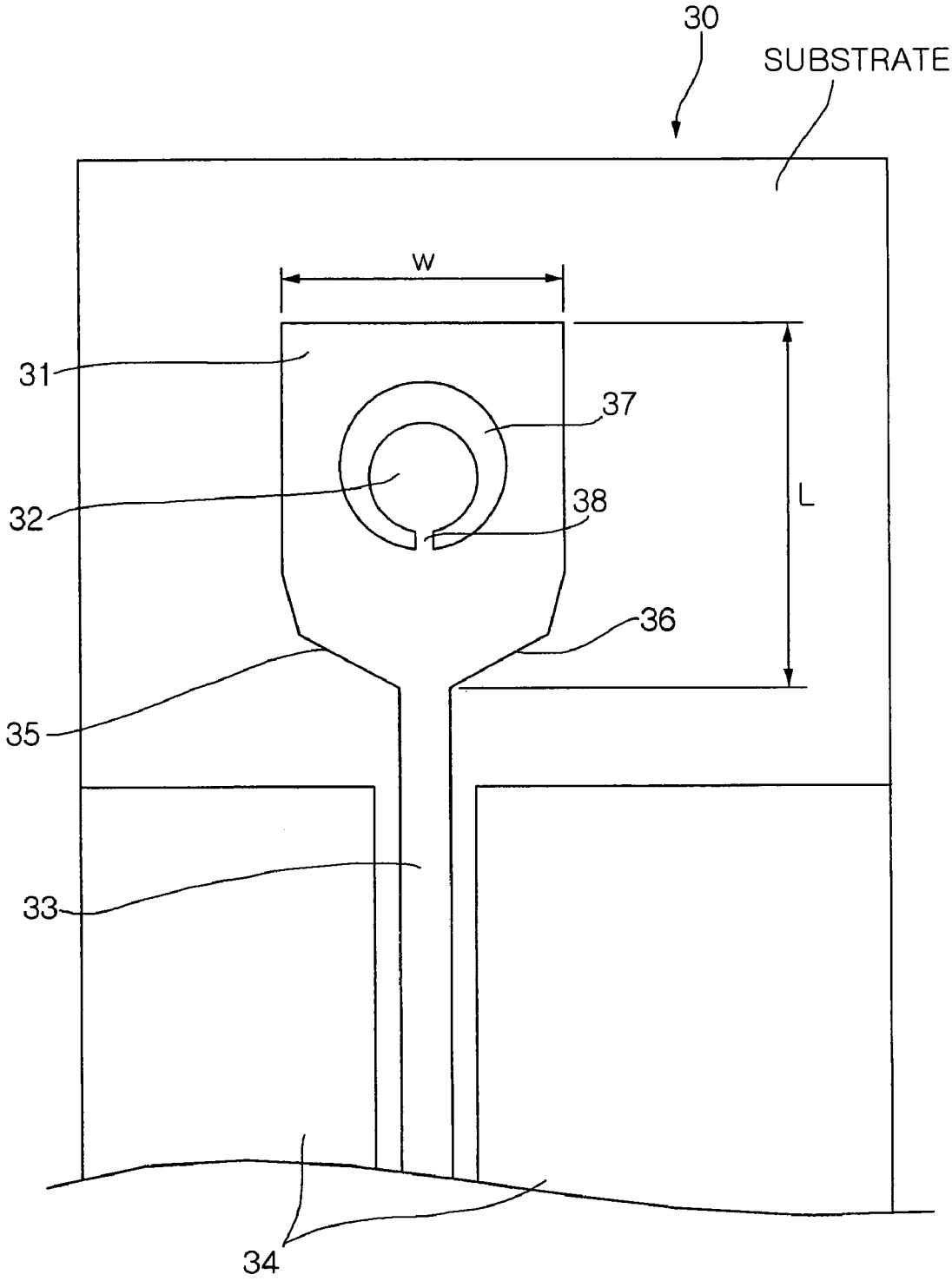
FIG. 3 is a view showing the construction of an ultra wideband internal antenna according to a first embodiment of the present invention.

FIG. 3 is a view showing the construction of an ultra wideband internal antenna according to a first embodiment of the present invention.

Referring to FIG. 3, an ultra wideband internal antenna 30 according to a first embodiment of the present invention is formed on a top surface of a dielectric substrate, and includes a first radiation part 31, a second radiation part 32, a feeding part 33 and ground parts 34.

The first radiation part 31 may be made of a thin metal plate having an outer circumference formed in a substantially rectangular shape, and preferably formed in a rectangle shape having a vertical length (L) slightly greater than a horizontal width (W). For example, the first radiation part 31 can be miniaturized to such an extent that its length (L)×its width (W) is approximately 1 cm×0.7 cm. Further, the first radiation part 31 has cut parts 35 and 36 formed by cutting out lower corner portions of the first radiation part 31. As shown in FIG. 3, each of the cut parts 35 and 36 may be formed in the shape of a polygonal cut part having a polygonal surface by cutting out both lower corner portions of the first radiation part 31 having the substantially rectangular shape, or may be formed in the shape of an arcuate cut part having a circular surface by cutting out both the lower corner portions in the form of a gentle curve.

Further, the first radiation part 31 has an internal slot 37. The internal slot 37 is formed by eliminating an internal portion of the first radiation part 31, and is preferably formed in a substantially circular shape. The shapes of the first radiation part 31 and the internal slot 37 can vary according to the ground and radiation characteristics of the antenna 30.

The second radiation part 32 is formed in the slot 37 of the first radiation part 31. Preferably, the second radiation part 32 has a size smaller than that of the slot 37 and is formed in a substantially circular shape. The second radiation part 32 may be concentric with the internal slot 37 in the first radiation part 31. In the meantime, the center of the second radiation part 32 may be somewhat spaced apart from the center of the internal slot 37 of the first radiation part 31. The shape of the second radiation part 32 can also vary according to the ground and radiation characteristics of the antenna 30.

The first and second radiation parts 31 and 32 are electrically connected to each other through a connection part 38. The connection part 38 is made of a conductor and may directly connect the first and second radiation parts 31 and 32 to each other, as shown in FIG. 3.

The feeding part 33 is formed in the shape of a long conductor line between the ground parts 34, and has a CO-Planar Waveguide Ground (CPWG) structure. The feeding part 33 is connected to a lower center portion of the first radiation part 31 and supplies current to the first radiation part 31. Further, the feeding part 33 supplies current to the second radiation part 32 through the connection part 38.

The ground parts 34 are formed on both sides of the feeding part 33, provided with upper ends spaced apart from the lower ends of the first radiation part 31 by a predetermined distance, and adapted to ground the antenna 30.

The ultra wideband internal antenna 30 according to the first embodiment of the present invention can attain 3 to 10 GHz ultra wideband characteristics through the following process. That is, when a current is applied to the feeding part 33, the current flows along the surroundings of the slot 37 of the first radiation part 31. Further, current flows through the second radiation part 32 through the connection part 38. Then, the first and second radiation parts 31 and 32 radiate electric waves using the currents flowing therethrough, and mutually influence their radiation due to electromagnetic coupling. Further, the size and shape of the slot 37 of the first radiation part 31 can be adjusted to form a 3 to 10 GHz ultra wide band due to the electromagnetic coupling. Further, in the ultra wideband internal antenna 30 according to the first embodiment, the cut parts 35 and 36 are formed on the first radiation part 31, thus improving antenna characteristics in a low frequency band around a frequency of 3 GHz. In a structure in which the first radiation part 31 does not include the cut parts 35 and 36, it is impossible to obtain a desired bandwidth due to the deterioration of radiation characteristics in the low frequency band around a frequency of 3 GHz, but, in the present invention, the cut parts 35 and 36 are formed on the lower circumference of the first radiation part 31 to obtain ultra wideband characteristics in a 3 to 10 GHz ultra wide frequency band.

Figure 4:
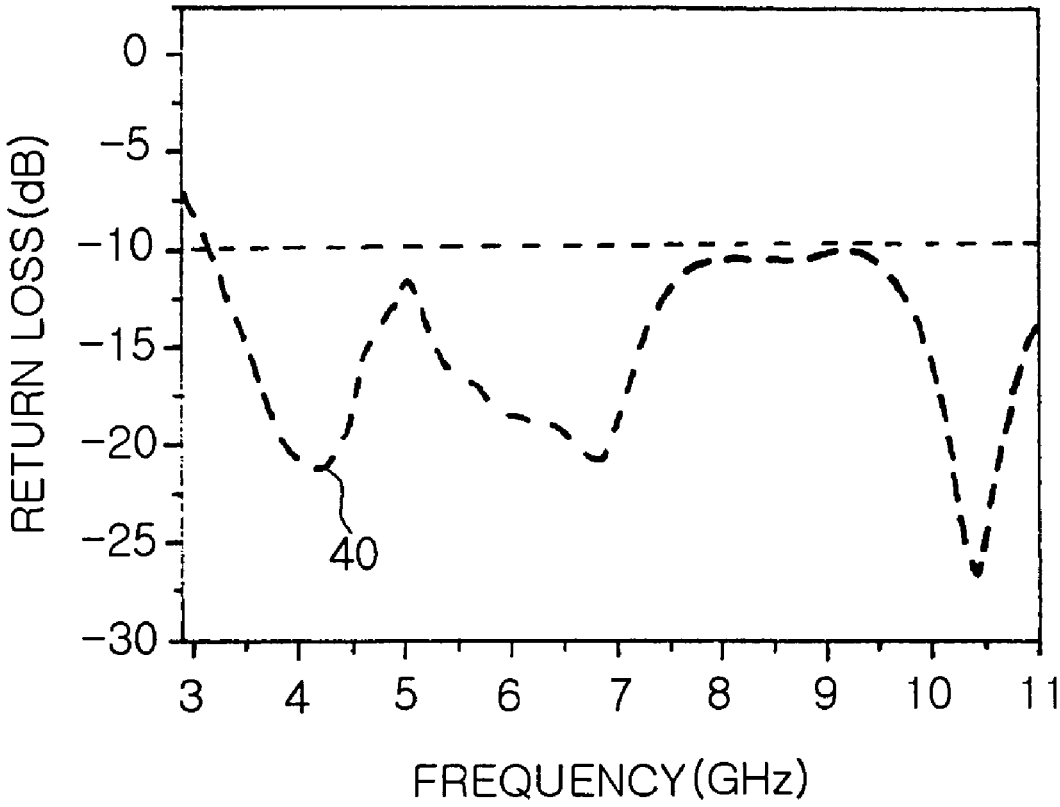
FIG. 4 is a graph showing the Voltage Standing Wave Ratio (VSWR) of the ultra wideband internal antenna according to the first embodiment of the present invention.

FIG. 4 is a graph showing the Voltage Standing Wave Ratio (VSWR) of the ultra wideband internal antenna according to the first embodiment of the present invention.

In the graph of FIG. 4, a vertical axis represents return loss graduated in decibels (dB), which shows a ratio of power input from a transmission system to a discontinuous part to power input from the discontinuous part to the transmission system, and a horizontal axis represents frequencies (GHz). Referring to the graph of FIG. 4, in the ultra wideband internal antenna according to the first embodiment of the present invention, if the bandwidth of the antenna is defined by a frequency bandwidth having a return loss of −10 dB or less, that is, having a VSWR of 2 or less, it can be seen that the return loss is −10 dB or less in about a 3 to 10 GHz frequency band, thus exhibiting ultra wideband characteristics. In a structure in which the cut parts 35 and 36 are not formed on the lower portion of the first radiation part 31, a return loss increases to −10 dB or above around a frequency of about 3 GHz. However, in the antenna according to the first embodiment of the present invention, the first radiation part 31 uses a structure in which the first and second radiation parts 31 and 32 are connected to each other and the cut parts 35 and 36 are formed on the lower portion of the first radiation part 31, so that it can be seen that the antenna has excellent ultra wideband characteristics while being miniaturized.

Figure 5:
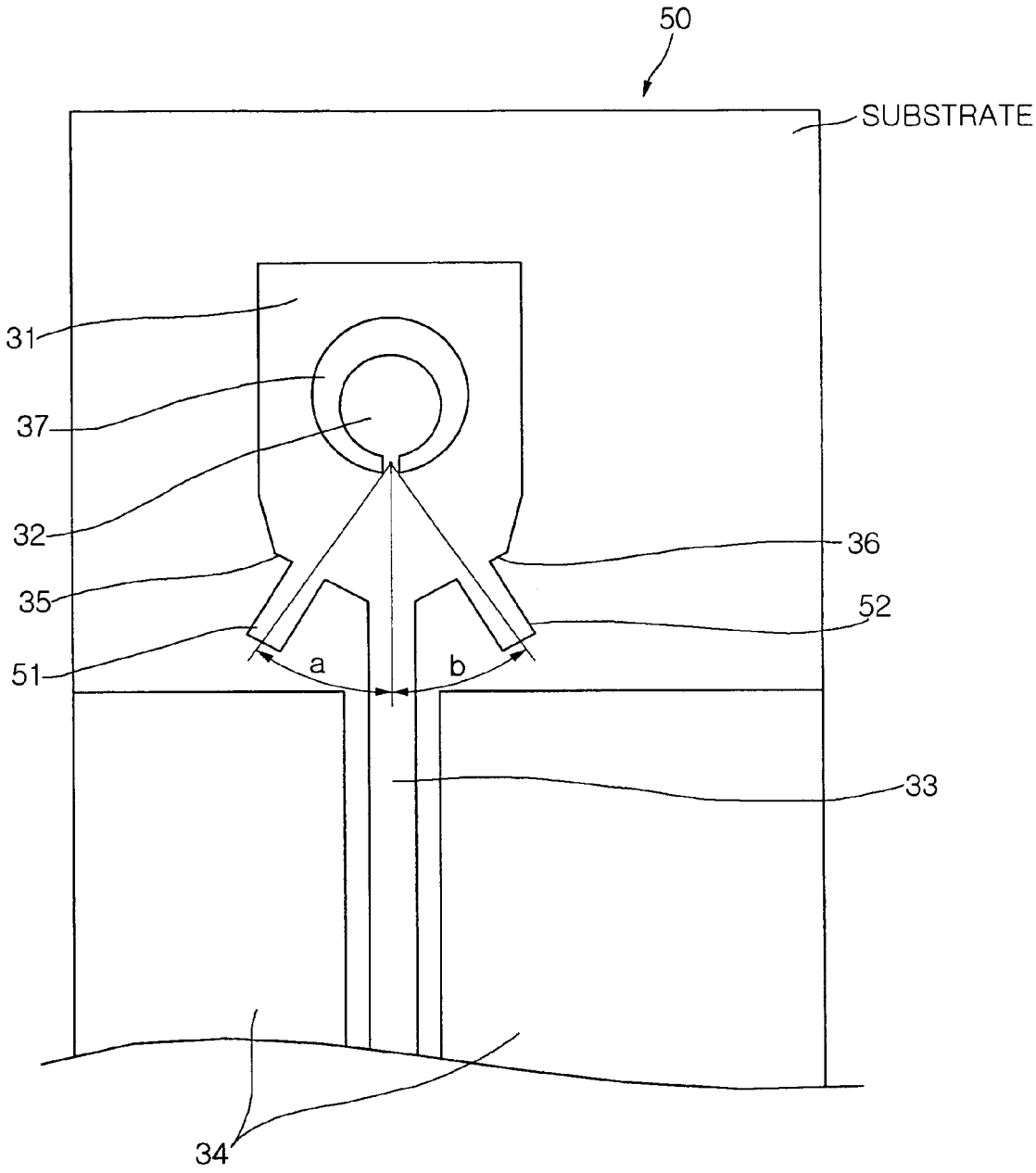
FIG. 5 is a view showing the construction of an ultra wideband internal antenna according to a second embodiment of the present invention.

FIG. 5 is a view showing the construction of an ultra wideband internal antenna according to a second embodiment of the present invention.

Referring to FIG. 5, an ultra wideband internal antenna 50 according to the second embodiment of the present invention is formed on a top surface of a dielectric substrate, and includes a first radiation part 31, a second radiation part 32, a feeding part 33 and a ground part 34, and additionally includes stubs 51 and 52 connected to the first radiation part 31.

The stubs 51 and 52 are formed in the shape of long striplines, and connected to cut parts 35 and 36 formed on the first radiation part 31 while protruding from the cut parts 35 and 36. Preferably, the stubs 51 and 52 are symmetrically formed around the feeding part 33. Further, the number of stubs 51 and 52 may be one, two or more depending on the frequency bands to be cut off by the antenna 50 according to the second embodiment of the present invention. Further, the stubs 51 and 52 can be formed asymmetrically around the feeding part 33. The stubs 51 and 52 have the characteristics of cutting off different frequency bands depending on whether an angle of inclination is "a" or "b" degrees with respect to the feeding part 33.

Further, the inductance value of the antenna can be adjusted depending on the extension length of the stubs 51 and 52, and the capacitance value of the antenna can be adjusted depending on the distance by which the stubs 51 and 52 are spaced apart from the ground parts 34. That is, the frequency band that can be cut off by the antenna can be adjusted according to the shape and position of the stubs 51 and 52.

Figure 6:
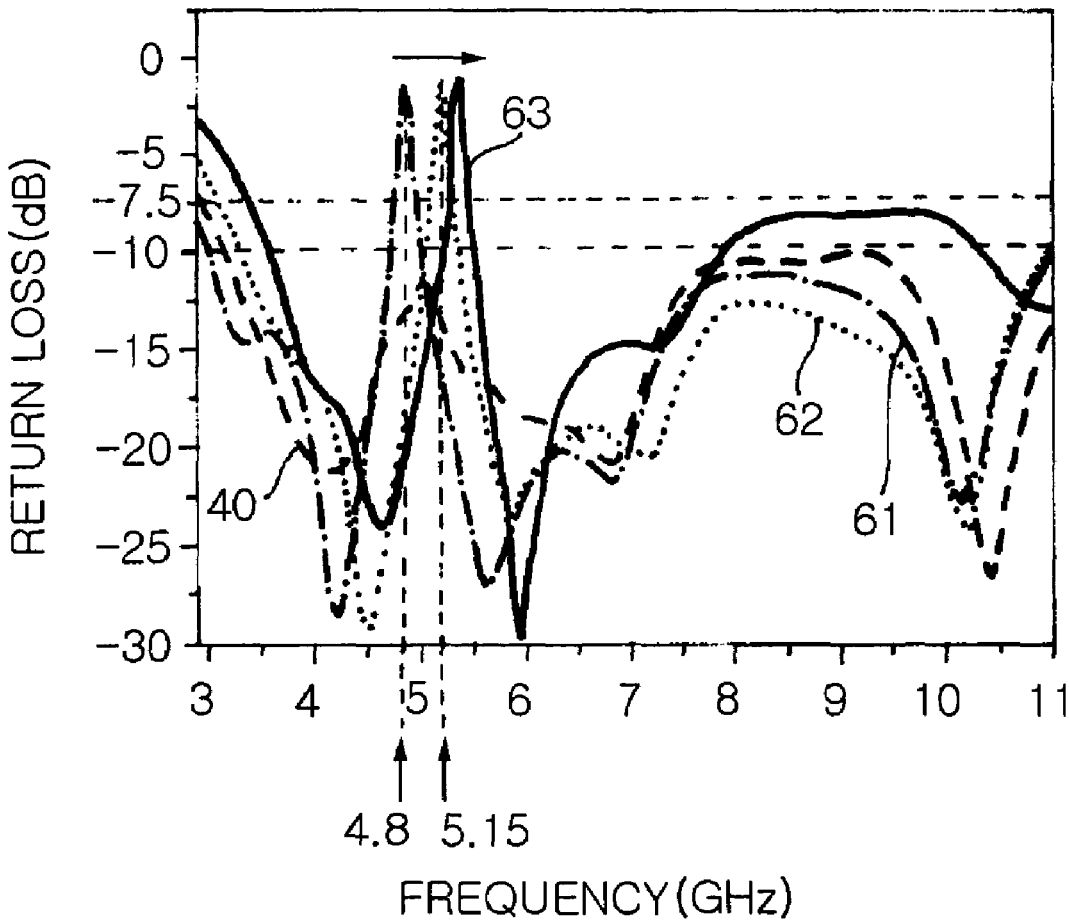
FIG. 6 is a graph showing the VSWR of the ultra wideband internal antenna according to the second embodiment of the present invention.

FIG. 6 is a graph showing the VSWR of the ultra wideband internal antenna according to the second embodiment of the present invention.

In the graph of FIG. 6, a vertical axis represents VSWR graduated in decibels (dB), and a horizontal axis represents frequencies (GHz). Reference numeral 40 denotes the frequency characteristics of the ultra wideband internal antenna 30 according to the first embodiment of the present invention. Reference numeral 61 denotes frequency characteristics when the stubs 51 and 52 of the ultra wideband internal antenna 50 according to the second embodiment of the present invention are individually inclined at an angle of 20 degrees with respect to the feeding part 33, wherein it can be seen that a frequency stop band is formed around a frequency of 4.8 GHz. Further, reference numeral 62 denotes frequency characteristics when the stubs 51 and 52 of the ultra wideband internal antenna 50 are individually inclined at an angle of 35 degrees with respect to the feeding part 33, wherein it can be seen that a frequency stop band is formed around a frequency of 5.15 GHz. In this case, a stop band for a wireless LAN using frequencies in a 5.15 to 5.35 GHz frequency band is formed, thus preventing signal interference with the wireless LAN system. Reference numeral 63 denotes frequency characteristics when the stubs 51 and 52 are individually inclined at an angle of 50 degrees with respect to the feeding part 33. As described above, a stop band can vary depending on the angle of inclination of the stubs 51 and 52 with respect to the feeding part 33 in the ultra wideband internal antenna 50 according to the second embodiment of the present invention. Accordingly, it can be seen that tuning the frequency stop band is possible.

According to the above-described present invention, an internal antenna provided within a mobile communication terminal can be miniaturized while having excellent radiation characteristics over a 3 to 10 GHz frequency band. Accordingly, the present invention is advantageous in that, when the ultra wideband internal antenna of the present invention is employed, miniaturization of a mobile communication terminal and design freedom thereof can be increased.

Further, the present invention is advantageous in that it can cut off frequencies in a certain frequency band while processing 3 to 10 GHz ultra wideband signals using the antenna included in a mobile communication terminal, thus preventing signal interference occurring when using the same frequency band as is used in other existing systems.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An ultra wideband internal antenna, comprising:

a first radiation part made of a metal plate on a top surface of a dielectric substrate and provided with at least one cut part, formed by cutting out a lower corner portion thereof, and an internal slot;

a second radiation part formed in the slot of the first radiation part while being connected to the first radiation part, the second radiation part being conductive;

a feeding part for supplying current to the first and second radiation parts; and a ground part for grounding both the first and second radiation parts, wherein the first and second radiation parts form an ultra wide band due to electromagnetic coupling therebetween using individual currents flowing into the first and second radiation parts.

2. The ultra wideband internal antenna according to claim 1, wherein the first radiation part has an outer circumference formed in a substantially rectangular shape.

3. The ultra wideband internal antenna according to claim 1, wherein the cut part is a polygonal cut part having a polygonal surface.

4. The ultra wideband internal antenna according to claim 1, wherein the cut part is an arcuate cut part that is formed by cutting the lower corner portion of the first radiation part in a gentle curve shape and is provided with a circular surface.

5. The ultra wideband internal antenna according to claim 1, further comprising at least one stub made of a conductive stripline and connected to the cut part of the first radiation part to cut off frequencies in a predetermined frequency band.

6. The ultra wideband internal antenna according to claim 5, wherein the stub is formed to be inclined at a predetermined angle with respect to the feeding part.

7. The ultra wideband internal antenna according to claim 5, wherein the stub is symmetrically formed around the feeding part.

8. The ultra wideband internal antenna according to claim 1, wherein the internal slot of the first radiation part is formed in a substantially circular shape.

9. The ultra wideband internal antenna according to claim 1, wherein the feeding part is formed in a CO-Planar Waveguide Ground (CPWG) structure.

10. The ultra wideband internal antenna according to claim 1, wherein the second radiation part is formed in a substantially circular shape.

* * * * *